United States Patent [19]

Hodsdon

[11] Patent Number: 4,972,051

[45] Date of Patent: Nov. 20, 1990

[54] SWITCH FOR TWO-WAY HAND-HELD TRANSCEIVER

[75] Inventor: Roy F. Hodsdon, Lynchburg, Va.

[73] Assignee: General Electric Company, Lynchburg, Va.

[21] Appl. No.: 390,285

[22] Filed: Aug. 7, 1989

[51] Int. Cl.[5] ..... H01H 13/70

[52] U.S. Cl. ..... 200/5 A; 200/512; 200/517

[58] Field of Search ..... 200/5 R, 5 A, 5 E, 6 R, 200/6 B, 6 BA, 6 BB, 6 C, 52 R, 512–517, 330, 343, 60

[56] References Cited

U.S. PATENT DOCUMENTS

| | | | |
|---|---|---|---|
| 3,691,324 | 9/1972 | Brantingson | 200/5 E |
| 3,909,564 | 9/1975 | Scheingold et al. | 200/5 E |
| 3,952,175 | 4/1976 | Golbeck et al. | 200/5 E |
| 3,963,886 | 6/1976 | Yen | 200/60 |
| 4,308,439 | 12/1981 | Itoh | 200/5 B X |

*Primary Examiner*—J. R. Scott
*Attorney, Agent, or Firm*—Nixon & Vanderhye

[57] ABSTRACT

A switch assembly comprises an element carrying a pair of hinged switch actuators and a universal devices connector. An outer member, preferably formed of rubber, overlies the actuators and underlies the connector whereby the placement of this switch sub-assembly comprising the element and member in the switch compartment of a portable radio seals the switches in the compartment. Actuation of the switches is accomplished by depressing a switch-actuation area in the flexible rubber member to pivot the underlying hinge to engage and depress an electrical switch. The sub-assembly is mounted in the compartment by a tongue-and-groove arrangement at one end, and a single retaining screw at its opposite end. Flexible electrical circuit carrier leads are threaded through a slot in the compartment wall to interconnect the switches and connector with the internal circuitry of the radio.

19 Claims, 4 Drawing Sheets

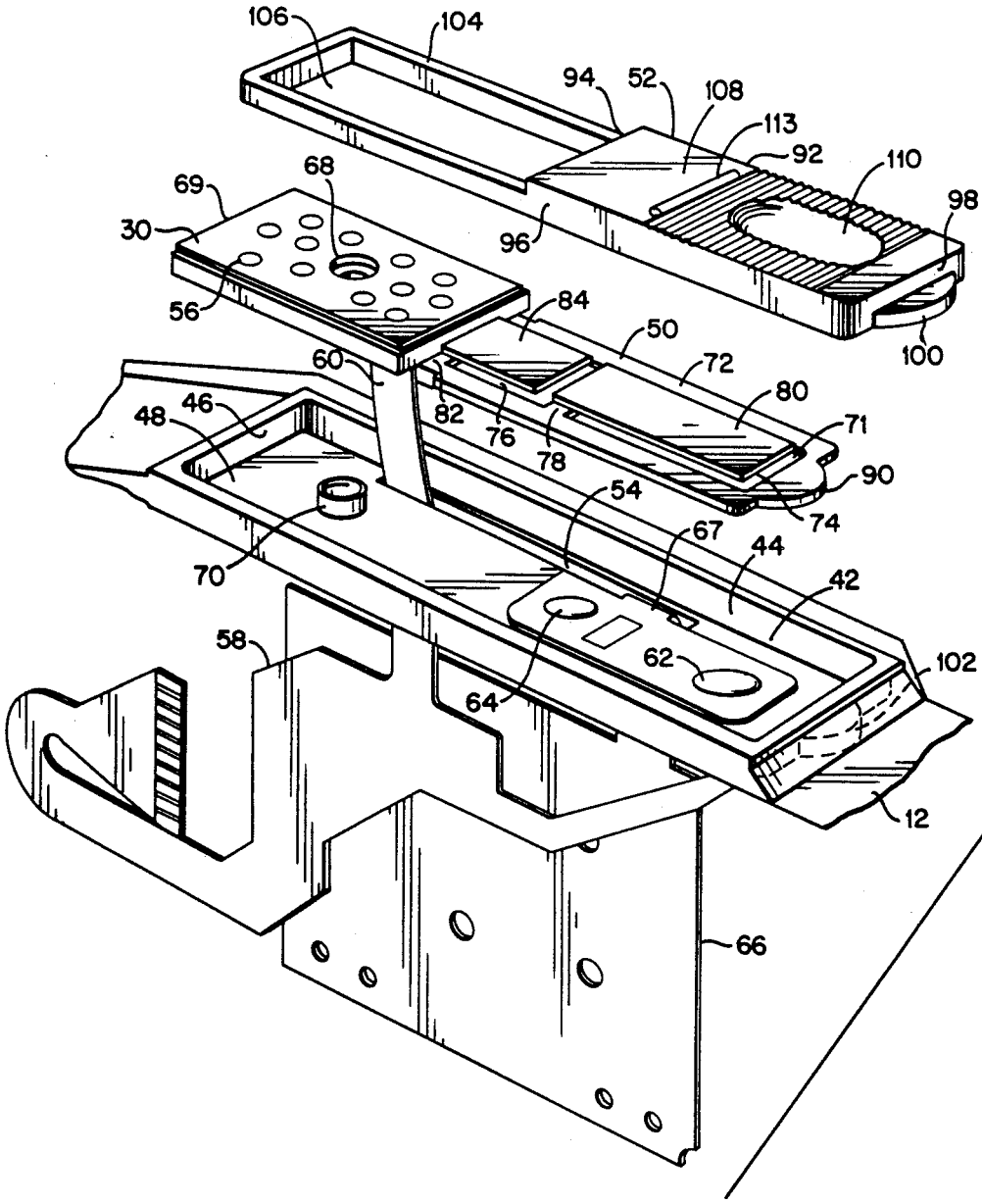
FIG. 2
FIG. 3
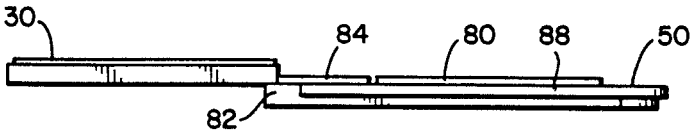

SWITCH FOR TWO-WAY HAND-HELD TRANSCEIVER

The present invention relates to portable radios and particularly relates to a simple, compact switch assembly and switch assembly/housing combination for use with a portable radio and particularly to a switch assembly and switch assembly/housing combination for the PTT (push-to-talk) switch, the monitor switch and the universal devices connector (e.g., a programmer connector) of a portable radio.

Various and different designs have been proposed and constructed in the past for the switches and connectors used in portable radios, including the PTT switches, monitor switches and universal devices connector. Those designs normally treat each switch and connector as a separate electro-mechanical assembly. None, however, to applicant's knowledge, have previously combined or integrated the functions of the switches and connector into a simple compact assembly. It will be appreciated that, in the highly competitive market for portable radios, it is desirable to provide switch assemblies and switch assembly/housings which are compact and inexpensive to produce. Savings in space in housing the switch assembly, minimization of the number of switch parts necessary to form the assembly and a reduction in assembly time are features which are very desirable in portable radios of this type.

In accordance with the present invention, there is provided a switch assembly and switch assembly/housing combination which meets these and other requirements and provides multi-functional unitary switch-actuating parts for both actuating underlying electrical switches and sealing the switch assembly within the switch assembly housing of a portable radio. In accordance with the present invention, there is provided a unique switch assembly and switch assembly/housing combination for housing, sealing and actuating the sealed PTT switch and sealed monitor switch, as well as housing and sealing the universal devices connector. It will be appreciated that the universal devices connector is interconnected via a UDC flexible circuit to a controller printed wireboard and a microphone located inside the radio or transceiver housing. The PTT switch and monitor switch include metal disks located on a keypad flexible circuit which disks, when depressed, actuate the appropriate circuitry.

More particularly, the present invention provides a generally rectangular-shaped recess in the radio housing having side, end and bottom walls. The switch-actuating metal disks carried by the flexible circuit and forming part of the switch assembly are disposed on the bottom wall adjacent one end of the recess and an internally threaded sleeve for receiving a screw for retaining the switch assembly in the housing is disposed adjacent the opposite end of the recess. It is an important feature of the present invention that the switch assembly comprises a sub-assembly of two switch-actuating parts, each of which is integrally formed. These parts are uniquely interconnected with one another such that the switch sub-assembly formed thereby form a seal for the electrical switches. One such switch sub-assembly part comprises an elongated, integral, flexible switch-actuating element, preferably formed of plastic material. The element includes a pair of cantilevered flexible hinges which form pivotal actuators for the underlying electrical switches carried by the bottom wall of the housing.

The hinges each include a depending switch-actuating pin which, upon depression of the corresponding hinge, engages the metal disk of the underlying switch to complete an electrical circuit. These switch-actuating hinges comprise approximately half the length of the element, with the remainder of the element forming the universal devices connector. The latter comprises a series of electrical contact pins exposed through the outer surface of the element and in contact on the inner surface with a flexible circuit.

In accordance with the present invention, the switch sub-assembly also includes a unitary flexible and resilient member which has a portion overlying the switch-actuating hinges of the element and a portion which underlies the universal devices connector. The flexible member portion overlying the hinges has depending side and end flanges and grooves are formed along the interior side walls for receiving projecting ribs on the side edges of the element. As part of a switch sub-assembly retention means, the member has a tongue projecting outwardly from the depending end flange. The tongue has a recess in its interior face for receiving an end projection formed on the element. The housing has a corresponding recess for receiving the projecting tongue of the member. The portion of the member underlying the universal devices connector extends about the periphery thereof and serves as a bearing and a seal for the remainder of the switch sub-assembly relative to the housing. The switch sub-assembly including the member and element is thus retained in the housing recess by engaging the projecting tongue of the member in the recess in the end wall of the housing compartment and providing a retaining screw through the universal devices connector for threaded engagement with the sleeve formed in the housing. This ensures that the switch sub-assembly is secured in sealing relation in the housing.

To actuate the PTT switch or the monitor switch, the flexible member is pressed inwardly in the areas thereof in registration with the underlying switches. For example, by pressing inwardly the area of the member in registration with the PTT switch, the underlying flexible hinge is pivoted such that its contact pin engages the metal disk of the PTT switch to actuate an associated electrical circuit. Similarly, by pressing inwardly the area of the member in registration with the monitor switch, the underlying flexible hinge is pivoted such that its contact pin engages the metal disk of the monitor switch to actuate an associated electrical circuit. Either one of the two switches may be actuated independently of the other by depressing the member in the corresponding switch-actuating area of the member, while maintaining the switch assembly sealed in the housing compartment. Additionally, the outer surface of the member may be variously configured, for example, by serrations, depressions or letter designations, to locate and identify the switch-actuating areas.

Accordingly, in accordance with a preferred embodiment of the present invention, there is provided a switch assembly comprising a pair of pressure-responsive electrical switches spaced one from the other and means for actuating the switches including a unitary flexible member overlying the pair of switches and having respective switch-actuating areas responsive to applied pressure for actuating the switches independently of one another. A flexible switch actuator is disposed between each of the switches and a respective switch-actuating area of the member and preferably includes a leaf spring. The member is also preferably comprised of rubber. Preferably, the switch assembly is provided in combination with a switch housing having side, end and bottom walls defining a recess in the housing, the switches being located adjacent the bottom wall of the housing. The member is located within the recess between the side and end walls and overlies the switches.

In a further preferred embodiment according to the present invention, there is provided a switch assembly comprising a switch housing having side, end and bottom walls defining a recess in the housing and a pair of pressure-responsive electrical switches spaced one from the other and located adjacent the bottom wall of said housing. Means are provided for actuating the switches including a unitary element carrying a pair of flexible switch actuators overyling the switches, respectively.

Accordingly, it is a primary object of the present invention to provide a novel and improved switch assembly and switch assembly/housing combination for a portable radio which minimizes the number of discrete parts necessary to form the switch assembly, provides multi-functions for the various parts of the switch assembly, is readily and easily assembled in the housing compartment and is generally compact in nature and inexpensive to manufacture.

These and further objects and advantages of the present invention will become more apparent upon reference to the following specification, appended claims and drawings.

BRIEF DESCRIPTION OF THE DRAWING FIGURES

FIG. 2 is an exploded perspective view of the switch assembly and housing therefor illustrating its various parts;

FIG. 3 is a side elevational view of a switch actuator forming part of the switch assembly hereof;

Figure 6:
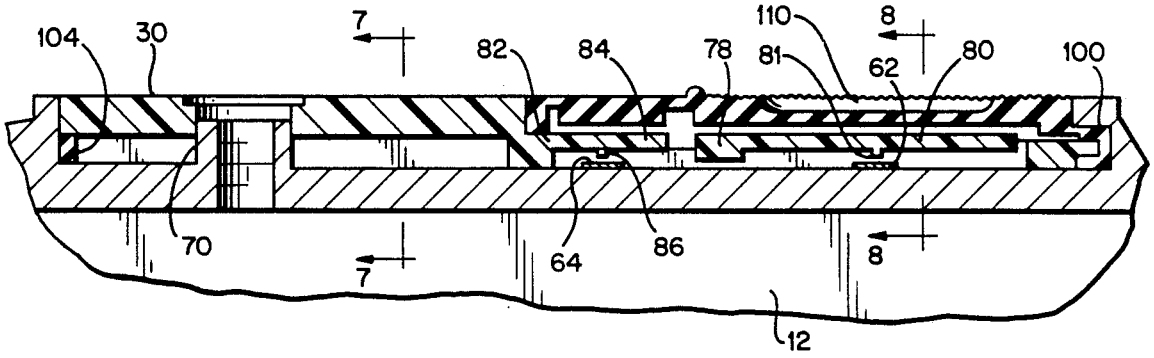
Figure 7:
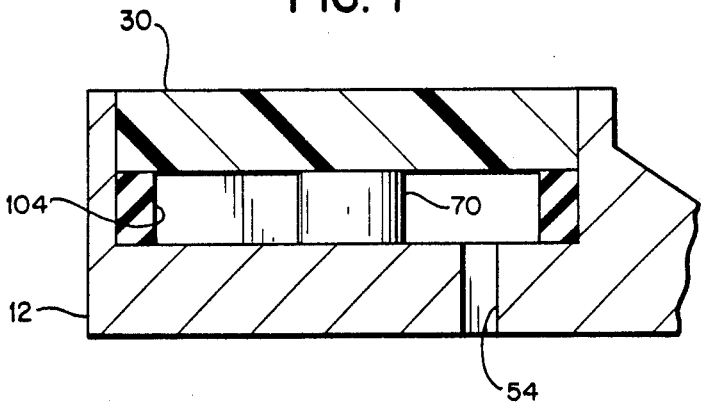
Figure 8:
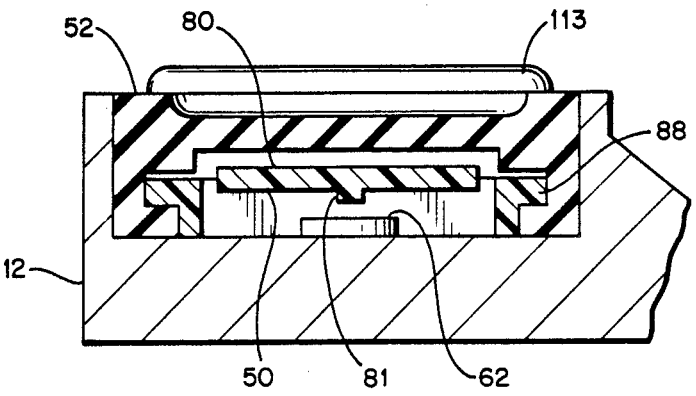

FIG. 6 is an enlarged fragmentary cross-sectional view of the switch assembly and housing therefor taken along a longitudinal axis of the assembly and housing; and FIGS. 7 and 8 are enlarged fragmentary cross-sectional views thereof taken generally about on lines 7—7 and 8—8, respectively, in FIG. 6.

DETAILED DESCRIPTION OF THE DRAWING FIGURES

Reference will now be made in detail to the present preferred embodiment of the invention, an example of which-is illustrated in the accompanying drawings.

Figure 1:
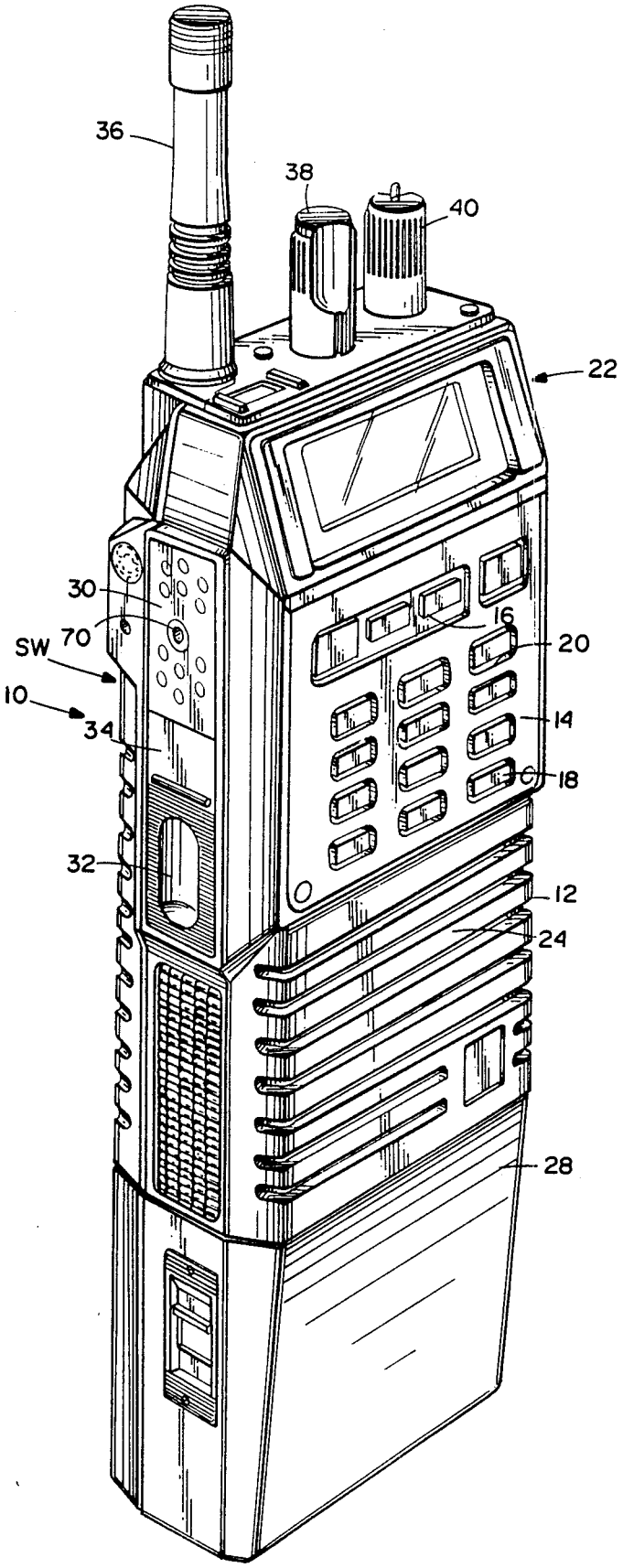
FIG. 1 is a perspective view of a mobile radio or transceiver unit incorporating the features of the switch assembly and switch assembly/housing combination of the present invention.

Referring now to the drawings, particularly to FIG. 1, there is illustrated a multi-frequency, portable hand-held transceiver unit, generally designated 10, including a housing 12, preferably formed of magnesium, having a front control panel 14 overlying a DTMF rubber keypad 16. Pad 16 has a number of individual keys 18 projecting through a corresponding plurality of apertures 20 in the control panel 14. An LCD display, generally designated 22, is mounted in an upper portion of the housing for viewing messages, channel names, status indicators, etc. A speaker grill 24 and microphone opening (not shown) are incorporated into housing 12 directly below the control panel 14. A battery 28 is operatively attached to the lower portion of the housing, and is easily connected/disconnected for replacement of batteries as needed. Other components of the radio include the switch assembly of the present invention, generally designated SW, which includes a universal devices connector 30, a transmit or PTT (push-to-talk) button 32, and a monitor button 34. Other components also include an antenna 36, a volume control knob 38, and a frequency selector knob 40. It is believed that the foregoing generalized description of the radio is sufficient for those skilled in the art to understand the environment in which the present invention, i.e., the switch assembly SW and housing therefor, is disposed.

Referring now to FIG. 2, it will be seen that, on a side of the radio housing 12, there is provided a generally rectangular recess 42 having side, end and bottom walls 44, 46 and 48, respectively, and which walls define a compartment for the switch sub-assembly comprising two unitary switch-actuating parts to be described, i.e., the switch actuator 50 and the flexible member 52. The bottom wall 48 of recess 42 divides or segregates recess 42 from the interior of radio 10 although an elongated slot 54 is provided through bottom wall 48 for passing flexible circuit-mounted leads interconnecting switch assembly SW and various electrical circuits within the radio housing 12. For example, universal devices connector 30 has a plurality of contacts 56 connected along the underside of connector 30 to electrical leads which form part of a flexible circuit 58 connected thereto by a lead carrier 60. Also fixed to the bottom wall 48 are a pair of metal disks 62 and 64, respectively, which form part of a keypad flexible circuit 66. Depression of the disks completes an electrical circuit through the keypad flexible circuit 66, a carrier lead 67 for which likewise passes through slot 54 into the interior of radio housing 12.

An important feature of the present invention resides in the provision of a switch sub-assembly comprised of a unitary element 50 serving multi-functions, as well as a unitary flexible member 52, likewise serving multi-functions. As best seen in FIGS. 2 and 3, unitary element 50 includes an integral elongated part comprised of a generally rectangular platform 69 adjacent one end and through which contacts 56 of connector 30 are inserted. Platform 69 also includes a central opening 68 for receiving a screw (FIG. 1) for securing the element 50 and member 52 in recess 42, as described hereinafter, by threaded engagement with the sleeve 70 formed in bottom wall 48. Element 50 also includes a coplanar extension 72 of platform 69 at a lower elevation thereof. Extension 72 has a pair of generally rectangular openings 74 and 76 separated one from the other by a bridging portion 78. Bridging portion 78 mounts a raised hinge 80 which overlies opening 74 and carries, as illustrated in FIG. 6, a depending switch-actuating pin 81. A bridging portion 82 adjacent platform 69 also mounts a hinge 84 in overlying registration to opening 76, hinge 84 likewise mounting a downwardly projecting pin 86. Hinges 80 and 84 are thus pivotable into openings 74 and 76, respectively. Pins 81 and 86 lie in registration with metal disks 62 and 64, respectively. The side edges of extension 72 include a pair of outwardly directed ribs 88 (FIG. 8). The distal end edge of extension 72 carries an outwardly directed projection 90.

Figure 4:
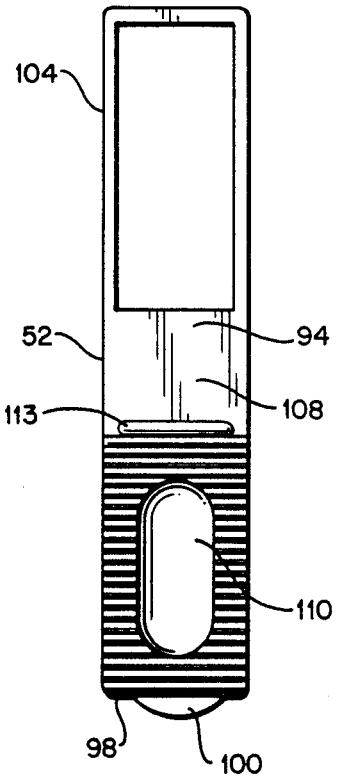
FIGS. 4 and 5 are top and bottom plan views, respectively, of flexible member forming part of the switch assembly hereof.
Figure 5:
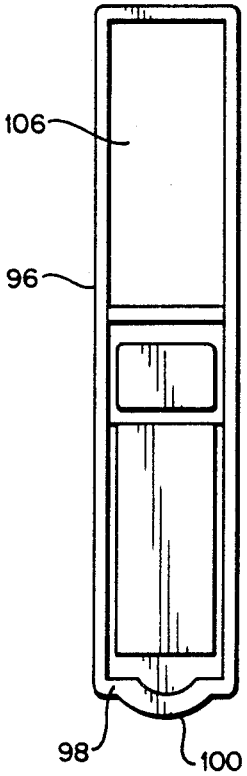

Referring now to FIGS. 2, 4 and 5, member 52 constitutes an integral or unitary flexible member, preferably formed of rubber. Member 52 includes a main body portion 92 comprised of a top wall 94, depending side walls 96, and an end wall 98. End wall 98 carries an outwardly projecting tongue 100 for reception in a recess 102 formed in the housing end wall 46. As illustrated in FIG. 8, the interior face of each side wall 96 is grooved to receive the ribs 88 of element 50. Tongue 100 is also internally recessed to receive the end projection 90 of extension 72. Member 52 also has a forwardly extending portion 104 having a central, generally rectangular opening 106. In assembly, the peripheral portion 104 underlies the universal devices connector 30 about the periphery thereof. It will also be seen that the top wall 94 of member 52 is elevated above the upper edge of peripheral portion 104 such that, in assembly, the top wall 94 is exposed externally of the radio lying flush with platform 69, while the peripheral portion 104 underlies device 30 and is thus not exposed externally of the radio. The top wall 94 is provided with switch-actuating identification areas 108 and 110. The switch-actuating area 108 in assembly lies in registration with hinge E4 and, hence, metal disk 64, while area 110 lies in registration with hinge 80 and metal disk 62. The switch areas 108, 110 may be smooth or configured as desired, to identify a switch-actuation area. For example, as illustrated, switch area 110 has a depression surrounded by a series of serrations or grooves 112. Switch area 108 is smooth between the connector 30 and an upstanding rib 113 and may have imprinted thereon a function designation, for example, the letter M for monitor switch.

In assembly, the carrier leads of the flexible circuits 58 and 66 are inserted through slot 54 and fixed to the underside of connector 30 and the bottom wall 48 of recess 42, respectively. The switch sub-assembly thus lies on opposite sides of the compartment 42 from circuits 58 and 66. Extension 72 is fitted along the underside of member 52 such that ribs 88 engage in the grooves in the side walls 96. The projection 90 is also received in the internal recess of tongue 100. The peripheral portion 104 is also located along the margins of connector 30 and along its underside. Thus, placement of the switch sub-assembly constituting the assembled element 50 and member 52 in recess 42 causes the member 52 to seal compartment or recess 42, thereby providing a seal for the switch-actuating disks 62 and 64 and about the contacts 56 along the undersurface of device 30. Upon placement in recess 42, the tongue 100 is received in recess 102 and opening 68 is aligned with sleeve 70. Thus, insertion of a single retaining screw serves, with the projecting tongue 100, to retain the switch sub-assembly sealed in compartment 42.

To actuate the PTT switch or monitor switch, the switch-actuating areas 110 or 108 of member 52 are depressed and hence depress the corresponding hinge 80 or 84. This, in turn, causes the actuating pins 81 or 86 to engage the metal disks 62 or 64, thereby to complete an electrical circuit.

It will thus be appreciated from the foregoing description that there has been provided a switch assembly and switch assembly/housing combination which includes a minimum number of parts in a space-saving manner and which parts are relatively inexpensive and serve multi-functions. For example, integral member 52 serves to seal the switch assembly in the radio housing while affording two switch-actuating areas and defining a third connector area. Actuator element 50 serves to carry the connector 30 and actuator hinges 80 and 84 for the PTT and monitor switches, respectively, while affording some rigidity and definition to member 52. Accordingly, the objectives of this invention, including minimization of the number of switch parts, ease of manufacture and assembly, and reduced costs, as well as other objects are fully accomplished.

While the invention have been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

what is claimed is:

1. A switch assembly comprising:

a switch housing having side, end and bottom walls defining a recess in said housing;

a pair of pressure-responsive electrical switches spaced one from the other and located adjacent the bottom wall of said housing; and means carried by said housing for actuating said switches, including a unitary flexible member overlying said pair of switches and having respective switch-actuating areas responsive to apply pressure for actuating said switches independently of one another, said member being located within said recess between said side and end walls;

said actuating means including a unitary element disposed in said recess and carrying a flexible switch actuator between each of said switches and a respective switch-actuating area of said member, said unitary element having side edges spaced from the side walls of said recess, said flexible member overlying the entirety of said switch actuators and extending between the opposite side walls of said recess, said flexible member extending between the side edges of said element and the opposing side walls of said recess on each of the opposite sides of said recess to form a seal therewith.

2. A switch assembly comprising:

a switch housing having side, end and bottom walls defining a recess in said housing;

a pair of pressure-responsive electrical switches spaced one from the other and located adjacent the bottom wall of said housing;

means carried by said housing for actuating said switches, including a unitary flexible member overlying said pair of switches and having respective switch-actuating areas responsive to applied pressure for actuating said switches independently of one another, said member being located within said recess between said side and end walls; and means for retaining the switch assembly in said housing recess, including an opening in one of said member and said walls and a projection carried by the other of said member and said walls for reception in said opening, said switches being located adjacent the bottom wall of said housing.

3. A switch housing having side, end and bottom walls defining a recess in said housing;

a pair of pressure-responsive electrical switches spaced one from the other and located in said housing adjacent the bottom wall thereof; and means carried by said housing for actuating said switches, including a unitary flexible member overlying said pair of switches and having respective switch-actuating areas responsive to applied pressure for actuating said switches independently of one another, said member being located within said recess between said side and end walls;

said actuating means including a unitary element disposed in said recess and carrying a flexible switch actuator between each of said switches and a respective switch-actuating area of said member; and means for retaining the switch assembly in said housing, including an opening in one of said member and said element and a projection carried by the other of said member and said element for reception in said opening.

4. A switch assembly comprising:

a switch housing having side, end and bottom walls defining a recess in said housing;

a pair of pressure-responsive electrical switches spaced one from the other and located in said housing adjacent the bottom wall thereof; and means carried by said housing for actuating said switches, including a unitary flexible member overlying said pair of switches and having respective switch-actuating areas responsive to applied pressure for actuating said switches independently of one another, said member being located within said recess between said side and end walls;

said actuating means including a unitary element disposed in said recess and carrying a flexible switch actuator between each of said switches and a respective switch-actuating area of said member; and said unitary element having side edges spaced from the side walls of said recess, said member having a top wall overlying said element including said actuators and dependent side flanges disposed between said side edges of said element and said side walls of said housing, respectively.

5. The combination according to claim 4 including means for retaining the switch assembly in said housing recess including a first opening in one of said member and said walls and a projection carried by the other of said member and said walls for reception in said first opening, said retaining means further including a second opening in one of said member and said element and a projection carried by the other of said member and said element for reception in said second opening.

6. A switch assembly comprising:

a switch housing having side, end and bottom walls defining a recess in said housing;

a pair of pressure-responsive electrical switches spaced one from the other and located in said housing adjacent the bottom wall thereof; and means carried by said housing for actuating said switches, including a unitary flexible member overlying said pair of switches and having respective switch-actuating areas responsive to applied pressure for actuating said switches independently of one another, said member being located within said recess between said side and end walls;

said actuating means including a unitary element disposed in said recess and carrying a flexible switch actuator between each of said switches and a respective switch-actuating area of said member; and a connector having a plurality of contacts and forming a part of said element, a flexible circuit carrier lead connected to said contacts, said member including means defining an opening for receiving said carrier lead.

7. The combination according to claim 6 wherein aid opening defining means includes a peripheral portion for engaging and sealing between said connector and said bottom wall of said recess.

8. A switch assembly comprising:

a switch housing having side, end and bottom walls defining a recess in said housing;

a pair of pressure-responsive electrical switches spaced one from the other and located in said housing adjacent the bottom wall thereof; and means carried by said housing for actuating said switches, including a unitary flexible member overlying said pair of switches and having respective switch-actuating areas responsive to applied pressure for actuating said switches independently of one another, said member being located within said recess between said side and end walls;

said actuating means including a unitary element disposed in said recess and carrying a flexible switch actuator between each of said switches and a respective switch-actuating area of said member; and a connector having a plurality of contacts and forming a part of said element, said member including a peripheral portion for engaging and sealing between said connector and said bottom wall of said recess.

9. The combination according to claim 8 wherein said switch housing recess is generally rectangular, each of said member and said element being substantially coextensive in length and width with said rectangular housing, said switch actuators and said connector lying adjacent opposite ends of said element, said member underlying said connector forming a bearing therefor with said bottom wall adjacent one end of said recess and overlying the switch actuators adjacent the opposite end of said recess.

10. A switch assembly comprising:

a switch housing having side, end and bottom walls defining a recess in said housing;

a pair of pressure-responsive electrical switches spaced one from the other and located adjacent the bottom wall of said housing;

means carried by said housing for actuating said switches including a unitary element carrying a pair of flexible switch actuators overlying said switches, respectively;

said element including a base having a pair of openings, each said actuator comprising a leaf spring overlying an opening and pivotal into said opening to actuate the corresponding switch;

said actuating means including a unitary flexible member having respective switches actuating areas overlying said leaf springs, respectively, responsive to applied pressure for pivoting said springs and thereby actuating said switches; and said unitary element having side edges spaced from the side walls of said recess, said flexible member extending between the side edges of said element and the opposing side walls of said recess on each of the opposite sides of said recess to form a seal therewith.

11. A switch assembly comprising:

a switch housing having side, end and bottom walls defining a recess in said housing;

a pair of pressure-responsive electrical switches spaced one from the other and located adjacent the bottom wall of said housing;

means carried by said housing for actuating said switches including a unitary element carrying a pair of flexible switch actuators overlying said switches, respectively;

said element including a base having a pair of openings, each said actuator comprising a leaf spring overlying an opening and pivotal into said opening to actuate the corresponding switch;

said actuating means including a unitary flexible member having respective switches actuating areas overlying said leaf springs, respectively, responsive to applied pressure for pivoting said springs and thereby actuating said switches; and means for retaining the switch assembly in said housing recess including an opening in one of said member and said walls and a projection carried by the other of said member and said walls for reception in said opening.

12. A switch assembly comprising:

a switch housing having side, end and bottom walls defining a recess in said housing;

a pair of pressure-responsive electrical switches spaced one from the other and located adjacent the bottom wall of said housing;

means carried by said housing for actuating said switches including a unitary element carrying a pair of flexible switch actuators overlying said switches, respectively;

said element including a base having a pair of openings, each said actuator comprising a leaf spring overlying an opening and pivotal into said opening to actuate the corresponding switch; and means for retaining the switch assembly in said housing recess including a first opening in one of said member and said walls and a projection carried by the other of said member and said walls for reception in said first opening, said retaining means further including a second opening in one of said member and said element and a projection carried by the other of said member and said element for reception in said second opening.

13. A switch assembly comprising:

a switch housing having side, end and bottom walls defining a recess in said housing;

a pair of pressure-responsive electrical switches spaced one from the other and located adjacent the bottom wall of said housing;

means carried by said housing for actuating said switches including a unitary element carrying a pair of flexible switch actuators overlying said switches, respectively;

said element including a base having a pair of openings, each said actuator comprising a leaf spring overlying an opening and pivotal into said opening to actuate the corresponding switch;

said actuating means including a unitary flexible member having respective switches actuating areas overlying said leaf springs, respectively, responsive to applied pressure for pivoting said springs and thereby actuating said switches; and a connector having a plurality of contacts and forming a part of said element, a flexible circuit carrier lead connected to said contacts, said member including means defining an opening for receiving said carrier lead.

14. A switch assembly according to claim 13 wherein said opening defining means includes a peripheral portion for engaging and sealing between said connector and said bottom wall of said recess.

15. A switch assembly comprising:

a switch housing having side, end and bottom walls defining a recess in said housing;

a switch housing having side, end and bottom walls defining a recess in said housing;

a pair of pressure-responsive electrical switches spaced one from the other and located adjacent the bottom wall of said housing;

means carried by said housing for actuating said switches, including a unitary element carrying a pair of flexible switch actuators overlying aid switches, respectively;

said actuating means including a unitary flexible member having respective switch-actuating areas overlying said switch actuators, respectively, responsive to applied pressure for actuating said switches;

said flexible member having (a) an opening therethrough spaced therealongfrom said switch-actuating areas, (b) a first portion underlying a first portion of said element and disposed in said member opening whereby the first portion of said element is exposed externally of said switch assembly and (c) a second portion overlying a second portion of said element, including said switches, whereby said second portion of said member is exposed externally of aid switch assembly.

16. A switch assembly according to claim 15 including a screw forming the sole securement between said switch assembly and said housing.

17. A switch assembly according to claim 15 wherein said unitary element has side edges spaced from the side walls of said recess, said flexible member extending between the side edges of said element and the opposing side walls of said recess on each of the opposite sides of said recess to form a seal therewith.

18. A switch assembly according to claim 15 wherein each said actuator comprises a leaf spring overlying an opening in said element and pivotal into said opening to actuate the corresponding switch, said switch-actuating areas of said flexible member overlying said leaf springs.

19. A switch assembly according to claim 15 including means for retaining the switch assembly in said housing recess including an opening in one of said member and said walls and a projection carried by the other of said member and said walls for reception in said opening.

* * * * *